United States Patent [19]

Alpkvist

[11] 4,364,724

[45] Dec. 21, 1982

[54] METHOD AND APPARATUS FOR DOSING AN AIR-FUEL MIXTURE IN BURNERS HAVING EVAPORATING TUBES

[75] Inventor: Jan A. Alpkvist, Linköping, Sweden

[73] Assignee: Förenade Farbiksverken, Eskilstuna, Sweden

[21] Appl. No.: 190,672

[22] PCT Filed: May 28, 1979

[86] PCT No.: PCT/SE79/00121

§ 371 Date: Feb. 2, 1980

§ 102(e) Date: Feb. 1, 1980

[87] PCT Pub. No.: WO80/00034

PCT Pub. Date: Jan. 10, 1980

[30] Foreign Application Priority Data

Jun. 2, 1978 [SE] Sweden ..... 7806536

[51] Int. Cl.[3] ..... F23D 11/44

[52] U.S. Cl. ..... 431/11; 236/15 BD; 431/12; 431/75; 431/90; 431/242; 431/247

[58] Field of Search ..... 431/12, 215, 210, 75, 431/90, 11, 242, 247; 236/15 BD

[56] References Cited

U.S. PATENT DOCUMENTS

| | | | |
|---|---|---|---|
| 3,072,468 | 1/1963 | Stitzer | 431/75 X |
| 3,299,841 | 1/1967 | Hemker et al. | 431/79 |
| 3,768,955 | 10/1973 | McLaughlin | 431/12 |
| 4,043,742 | 8/1977 | Egan et al. | 431/12 |
| 4,063,870 | 12/1977 | Deruelle | 431/75 |
| 4,118,172 | 10/1978 | Noir et al. | 431/12 |
| 4,255,116 | 3/1981 | Zwick | 431/12 X |
| 4,255,122 | 3/1981 | Alpkvist et al. | 431/215 |

*Primary Examiner*—Edward G. Favors

*Attorney, Agent, or Firm*—James C. Wray

[57] ABSTRACT

A method and an apparatus for dosing the air-fuel mixture in burners of the type which is formed with an evaporator tube (9) through which fuel and some amount of combustion air is introduced in the combustion chamber (1) and in said combustion chamber is mixed with further combustion air and is inflamed. The optimum amount of combustion air is determined for different amounts of fuel and for different reference temperatures in a predetermined point of the evaporator tube (9) adjacent the mouth (10) thereof in the combustion chamber (1), and the temperature of the air-fuel mixture is measured by means of a thermo element (41) in the said point of the evaporator tube (9). In an electronic unit (34) the actual temperature is compared with the predetermined reference temperature for a given amount of injected fuel, and in case of an actual temperature below or above respectively the reference temperature the amount of combustion air is reduced or increased respectively by means of a control means in proportion to the measured temperature difference until the actual temperature has increased or dropped respectively to the reference temperature, what follows according to a programmed curve.

7 Claims, 4 Drawing Figures

METHOD AND APPARATUS FOR DOSING AN AIR-FUEL MIXTURE IN BURNERS HAVING EVAPORATING TUBES

The present invention relates to a method and an apparatus for dosing the air-fuel mixture in burners of the type which is formed with an evaporating tube, through which the fuel and some amount of combustion air is introduced in a burner chamber and is mixed with further combustion air and is inflamed.

Burners of this type are intended to be used in case a high efficiency is wanted like in burners for all kinds of heating purposes as villa burners, gas turbines, steam turbines etc. A special field of use is burners in such types of engines in which a working fluid in a closed fluid system is subjected to heating and cooling respectively and in which the said temperature differences are utilized for driving the active parts of the engine like for instance pistons. A such type of motor is the so called Stirling motor. For the sake of simplicity the invention will mainly be described in connection to such Stirling motor, but it is to be understood that the invention is not restricted to the said field of use and that the invention can be used for many other purposes.

In all combustion where it is tried to get a high efficiency and low emissions of harmful products the fuel and the air must be dosed to a particular relationship. In order to get a good combustion the reaction ought to follow by excess of air. The theoretical amount of air which is needed for combustion of a special amount of fuel is named λ (lambda), and excess of air consequently means that λ is higher than 1. The optimum λ-value varies depending on the design of the burner, the type of fuel, the load of the burner etc. Emperically the optimum λ-value can be determined, and the said value may simplified often be represented as a straight line. In a special burner the optimum λ-curve shown in FIG. 3 has been obtained.

In FIG. 3 the amount of fuel is given in grams per second, and along the horizontal axis the excess of air λ is stated. It is evident that the λ-value varies depending on the amount of fuel and that the λ-value is reversed proportional to the amount of fuel, i.e. that a high amount of fuel claims a relatively low λ-value, whereas a little amount of fuel claims a relatively high λ-value. In varying the load of the burner a varying amount of fuel has to be injected, and thereby also the λ-value must be controlled.

In a previously known apparatus the control of the λ-value is made in that the fuel pump and the fan for the combustion air are connected to the same shaft but with a predetermined gear change, so that the amounts of fuel and combustion air theoretically follow a calculated or empirically stated curve for the optimum λ-value. Such apparatus may during some condutions give a satisfactory result, but after some time of combustion large differences from the optimum relationship may appear depending on leakage both in the fuel system and the air system, that the temperatures of the injected fuel and air vary etc.

In another previously known control apparatus for dosing the air-fuel mixture a chemical sensor or probe of special type is applied inside the burner or in the flue-gas channels for sensing the chemical composition of the flue gases. Such proves, however, are exposed to very strong thermical action, to risks of being oxidized or being sooted etc., and therefore the chemical probes have a restricted lifetime and give an unsafe result. No λ-probes of the said type appearing on the market today are capable, for different reasons, to measure or control λ-values which are higher or lower than 1,0, and the said probes therefore can not be used in the burner systems intended with the present invention in which the optimum λ-value is substantially higher than 1,0.

At present the λ-value in combustion is controlled in that the amount of air pumped into the burner chamber through an air channel is measured, and the said amount of air is allowed to define the flow of fluid according to a predetermined λ-curve. This can be made for instance by means of a difference-pressure-giver which over a pitot-tube or similar means is connected to the air channel and measures the amount of air passing by, and the signal from the difference-pressure-giver is applied to an electronic unit which relates the amount of air to the amount of fuel according to the predetermined λ-curve and causes the corresponding amount of fuel to be injected in the burner chamber. Often a temperature probe can be connected inside the medium to be heated or to the wall defining said medium, and the said temperature probe is likewise connected to the electronic unit and indicates when the temperature exeeds and decreases respectively a wanted temperature, whereby the electronic unit acts on an air control valve which reduces and increases respectively the incoming amount of combustion air, whereby the change of amount of air in turn provides a control of the injected amount of fuel so that the temperature is changed to the intended value at the same time as the λ-value is maintained according to the predetermined λ-curve.

The above mentioned system is a so called calibrated system in which the control of the flow of air and the flow of fuel is made outside the burner chamber, which system can not consider any leakage etc. of the system. Thus if there should be a leakage at some place between the difference-pressure-giver and the burner chamber or in the fuel pump or the conduit to the burner chamber the combustion follows a λ-value which differs from that of the intended λ-curve. The discribed system for controlling the λ-value also is complicated and impaired with several sources of error. Also the system is expensive to manufacture and maintain.

In conventional burners like oil burners for villa boilers etc. the amount of injected fluid normally is constant and when installing the apparatus the amount of air is adjusted to a fixed value by a CO-analysis. Since the relationship between air and fuel for different reasons changes the amount of air is later readjusted, generally once a year. Such fixed systems give a very imperfect result, and in front of all such systems do not consider the outer circumstances like different types of oil, temperature and moisture variations of the air, possible leakage which may appear, wear of the injection nozzles etc.

The object of the invention therefore is to provide a method and an apparatus for exactly dosing air and fuel according to a predetermined λ-curve in which the control is indicated directly from the burner chamber and in which the apparatus consequently considers the actual amount of fuel and air at the place of combustion. Also in the apparatus according to the invention outer circumstances as leakage is of no importance for getting a combustion exactly according to a predetermined λ-curve.

The invention is based on the fact that the temperature at a predetermined place of the evaporizing tube of a burner and for a predetermined amount of fuel is an exact dimension on the amount of air, and according to the invention therefore a temperature probe is mounted at a predetermined place in the evaporizing tube, preferably adjacent the mouth of the evaporizing tube in the combustion chamber, and the said temperature probe is connected to an electronic unit to which also actuation means for an air control valve and for a fuel pump are connected. The system according to the invention also can be used for constant operation, whereby for instance the combustion temperature, the temperature of the working medium, the tube wall temperature of the working medium or similar is kept constant, but the system may as well be used for varying operation, whereby different power of the working medium is used, i.e. in the above mentioned appliance of the Stirling motor, and whereby the combustion is varied depending on the said varying power.

In the following specification the invention will be described more in detail in connection to one embodiment thereof and with reference to the accompanying drawings.

In the drawings

FIG. 1 diagramatically and in a cross section shows a burner designed according to the invention, and FIG. 2 shows a diagram over an optimum excess of air λ related to a flue of fluid for three different temperatures.

Figure 1:
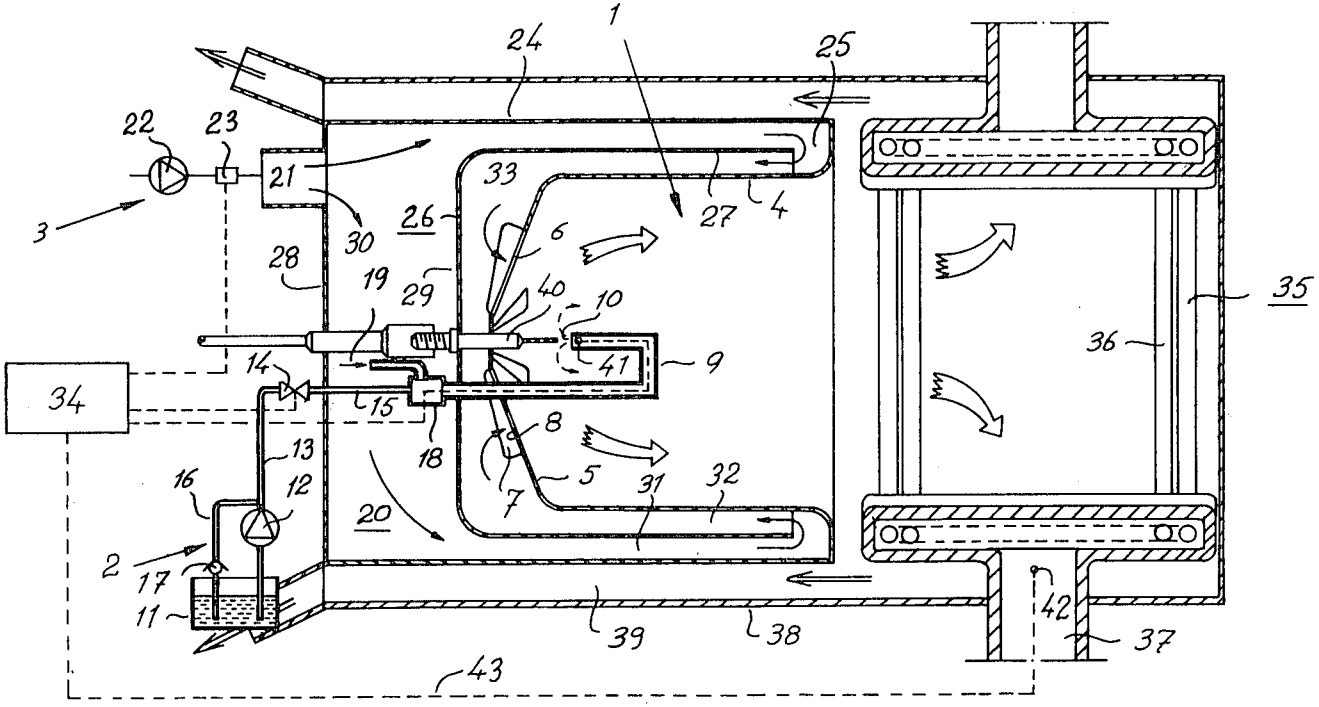

The burner shown in FIG. 1 generally comprises a cup-formed combustion chamber 1, and an apparatus 2 for injecting or pump-introducing fuel and an apparatus 3 for pump introducing combustion air.

The burner chamber 1, which in the illustrated case is circular cylindrical comprises combustion a chamber 4 and a combustion chamber bottom 5 in which the inlet for the combustion air is provided. The air inlet at the bottom 5 of the combustion chamber is formed by a number of slots 6 having bent outflow lips 7 which are punched out from the burner chamber bottom 5 and which are integral therewith along one side 8 and which are bent out from the burner chamber at an angle 25° to the burner chamber bottom. The air slots provide a turbulating inlet together with the flowlips 7 in that the air, when passing the slots, is given an axial screw movement. In order to give the best possible air flow the burner chamber bottom is widened conically outwards and it encloses a cone angle of about 140°. The burner chamber walls 4 may be conical outwards, for instance at an angle of about 5°–10°.

The fuel system 2 is formed by an evaporator tube 9 which extends through the burner chamber bottom 10 and which with its open end 10 is facing the burner chamber bottom. The fuel from the evaporator tube 9 is received from a fuel tank 11 and is pumped by means of a pump 12 through a conduit 13 over a control valve 14 and a further conduit 15 into the evaporator tube 9. From the outlet the fuel pump 12 a return conduit 16 and a non-return valve 17 are mounted for enabling a control of the amount of fuel without changing the pump action of the fuel pump 12. Between the conduit 15 and the evaporator tube 9 a mixing chamber 18 for fuel and air is provided and the said mixing chamber is formed with an air inlet 20 which may be controllable and which diverts a predetermined amount of combustion air into the mixing chamber 18, whereas the remaining amount of combustion air is allowed to enter through the air slots 6 of the combustion chamber bottom 5. The amount of air supplied to the mixing chamber 18 has to be so small that the air-fuel mixture entering the combustion chamber through the evaporator tube 9 is not inflamed inside the evaporator tube. The amount of air supplied to the mixing chamber 8 may be between 4 and 15% or preferably between 6 and 10%.

The air system 3 for supplying combustion air includes an air chamber 20 which is closely connected to the outer end of the combustion chamber 1 and which has an inlet 21 for air supplied by a pump or a fan 22 over a control valve 23. Between the combustion chamber walls 4 and the walls 24 of the air chamber 20 there is an annular space 25 which is divided into an air labyrinth by means of a labyrinth cup 26 which with the walls 27 thereof extends into the annular space 25 thereby dividing same into two substantially like parts. The outer end of the labyrinth cup 26 is provided spaced from the outer end of the air chamber 20 so as to allow a turning over of the air. Between the bottom 28 of the air chamber and the bottom 29 of the labyrinth body 26 the two parts provide an inflow chamber 30 in which the incoming air is distributed with an even pressure, and the walls 27 of the labyrinth cup 26 define an outer flow channel 31 and an inner flow channel 32 through which the incoming air passes into an expansion chamber 33 provided between the combustion chamber bottom 5 and the bottom 29 of the labyrinth cup.

The amount of fuel is controlled by means of the valve 14, and the amount of combustion air is controlled by the valve 23 and both valves 14 and 23 are connected to an electronic unit 34 which can be programmed with an λ-curve for fuel and excess of air respectively based on the temperature of the air-fuel mixture in the evaporator tube 9.

In the illustrated case the burner is connected to a heater 35 for water, gas, air or any other medium. A special field of use for the invention is hot air motors or hot gas motors like Stirling motors in which the operating air or gas must be quickly heated to a very high temperature. For such application the heater 35 is formed as a closed channel system for the operative air or gas, in which the gas channels are formed by heat receiving tubes (of which only four tubes are shown) and a collector 37. The heat receiving tubes 36 are mounted axially following just outside the combustion chamber 1, whereby the combustion gases are allowed to pass between the heat receiving tubes 36 and out through an exhaust gas jacket 38 enclosing both the burner and the heater 35. The exhaust gas jacket 38 provides an exhaust gas channel 39 between itself and the air chamber walls 24 in which the exhaust gases are cooled in counter current to the air entering through the outer air flow channel 31.

In order to provide an inflaming of the air-fuel mixture when the burner is cool an ignition plug 40 is provided in the combustion chamber in front of the mouth of the evaporator tube 9, and the ignition plug is in the conventional way connected to a non-illustrated source of current for providing the inflaming spark.

According to the invention a thermo element 41 is mounted inside the evaporator tube 9 adjacent the mouth thereof inside the combustion chamber and the thermo element 41 is over a conduit connected to the electronic unit 34. As previously mentioned the electronic unit 34 is adapted for being programmed according to one or more λ-curves for giving an optimum excess of air λ for any operation condition. The primary controlling is provided by controlling the air control valve 23, and a secondary controlling is provided by a control of the fuel valve 14 depending on the change of temperature obtained when controlling the air valve 23.

The thermo element 41 which is mounted freely, preferably centrally inside the evaporator tube 9 measures the temperature of the air-fuel mixture introduced in the combustion chamber. The said temperature is a direct dimension of the amount of air in relation to the amount of fuel for the specific λ-curve.

Figure 4:
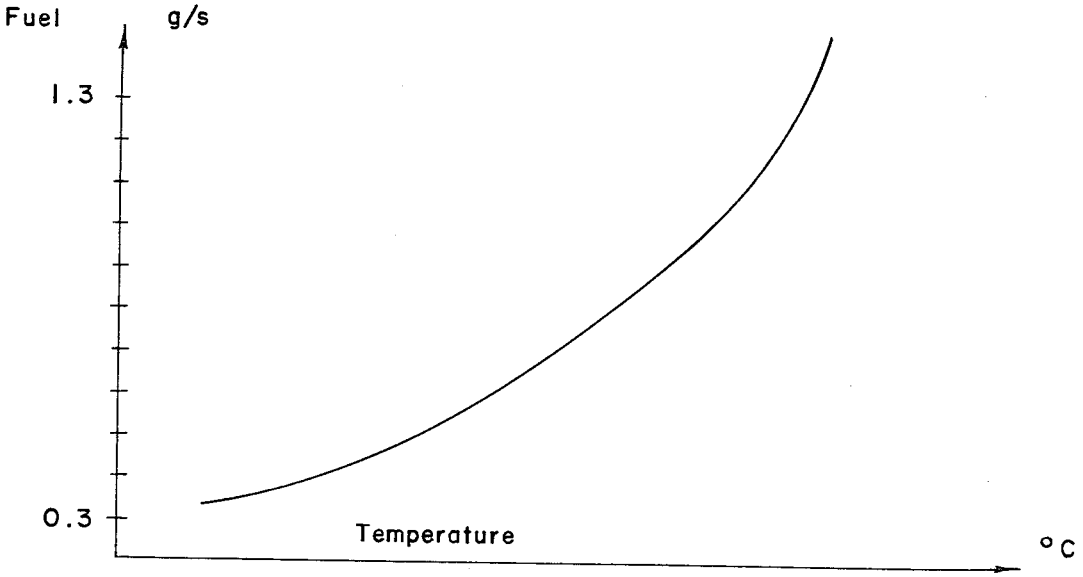
FIG. 4 shows a general curve of relationship between amount of fuel and temperature.

By measuring the said temperature signal for a particular burner over the entire operation area and for the wanted λ-curve for instance the general curve illustrated in FIG. 4 can be obtained:

The said curve thus represents the reference-value for a correct. λ-curve over the operation area. The said reference-value has to be related in the electronic unit 34 to the actual measured temperature.

In its most simple embodiment the system is provided to always give an excess of air which is exactly related to the programmed λ-curve.

If the temperature of the air-fuel mixture in the evaporator tube registered by the thermo element 41 should be to high as compared with the temperature of the programmed λ-curve corresponding to the actual amount of fuel adjustment has to be made. As mentioned above the temperature of the air-fuel mixture in the evaporator tube is a function of the mixing relationship of air to fuel, and a too low temperature gives an indication of a too high excess of air, whereas a too high temperature indicates a too low excess of air. If the temperature observed by the thermo element at a certain predetermined injected amount of fuel should be too high this is an indication that the λ-value is too low, and the electronic unit 34 thereby provides an opening of the air valve 23, so that an increasing amount of air is pumped into the combustion chamber. Correspondingly a choking of the air valve 23 is obtained in case of a too low temperature in the evaporator tube. Since the thermo element provides a controlling of the air-fuel mixture in the very combustion chamber a complete compensation of any appearing leakage of air is thereby obtained. Therefore, it there should be a leakage in the air system, so that some amount of air leaks out to the ambient air the temperature is increased in the combustion chamber depending on a too low λ-value, and this is registered by the thermo element, whereupon a correction is immediately introduced.

The system according to the invention can relatively simply be adapted so as to give an exact temperature for the working medium of the heater 35, and for this purpose a second thermo element 42 can be provided in the said working medium. The second thermo element 42 is connected to the electronic unit 34 over a conduit 43.

At normal operation without change of the power output of the motor driven from the heater 35 the air valve 23 is quickly adjusted to correct λ-value in relation to the injected amount of fuel. If an increasing power is taken out from the motor connected to the heater 35 the temperature of the working medium drops and the thermo element 42 registers a drop of temperature. Thereby a signal is given from the electronic unit 34 to the air valve 23 which opens thereby letting more combustion air into the combustion chamber. At the same time an increasing amount of air enters the evaporation tube and the temperature of the air-fuel mixture in the evaporation tube drops. The thermo element 41 registers the said dropping temperature to the electronic unit which thereby relates the amount of combustion air and the injected amount of fuel to the programmed λ-curve and a signal is given to the fuel valve 14 to increase the flow of fuel until the correct reference-value thereof is obtained. If thereafter a reduced power is taken out from the motor connected to the heater 35 the air valve 23 is choked and likewise the fuel valve 14 is choked to an amount controlled according to the λ-curve.

When starting up the burner the temperature regulator of the evaporator can not be connected since the low temperature thereby should control the injection valve to a maximum flow of fluid. One way of managing a starting up is to lock the injector at a certain amount of injection which together with the amount of air given by the fan allows a correct air-fuel mixture in the combustion chamber in this position. When the temperature after some time has passed the reference-value of the evaporator the lock of the fuel injector is released and the above described air-fuel controlling begins.

Figure 2:
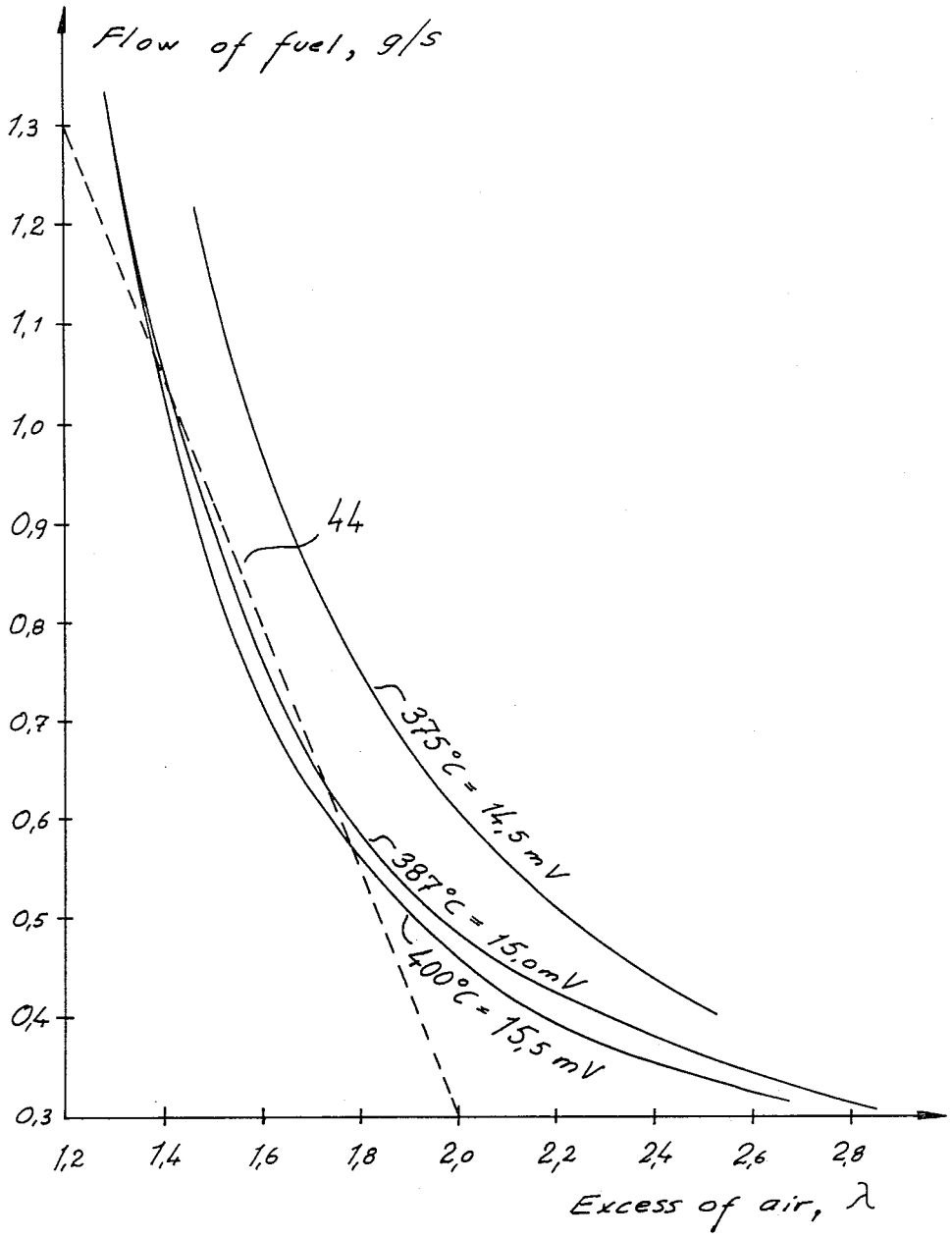
Figure 3:
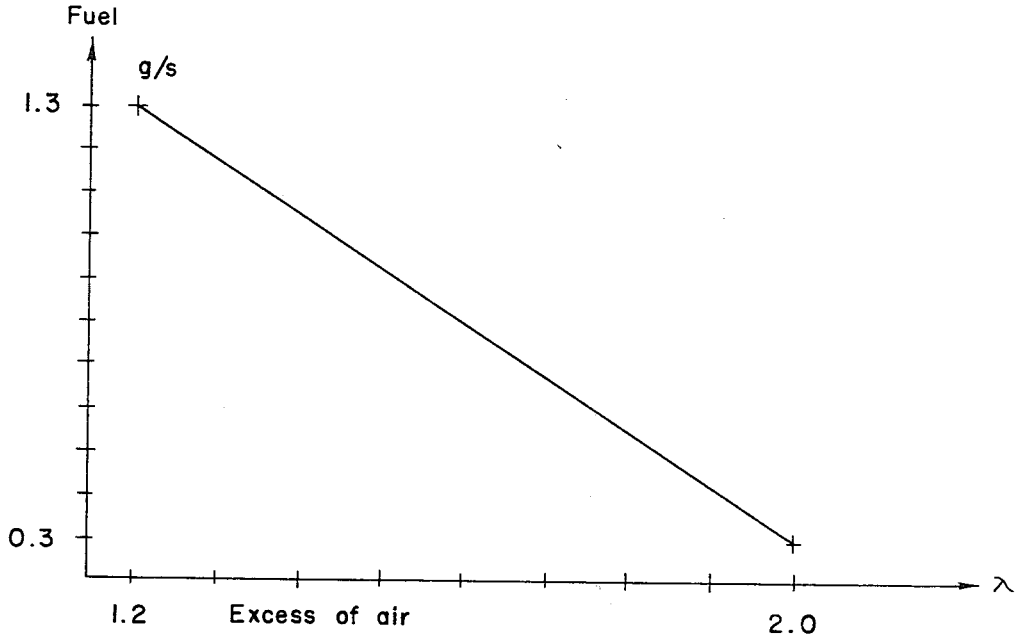
FIG. 3 shows the above mentioned optimum λ-curve.

FIG. 2 shows a number of curves over registered λ-values for constant should-values of the outlet temperature at the evaporator. Along the abscissa is marked the excess of air λ and along ordinate is marked the injected amount of fluid expressed in grams per second. The dotted line 44 shows the actual specified λ-curve whereas the full lines indicate curves for three different temperature values, viz 375° C. corresponding to 14,5 mV, 387° C. corresponding to 15,0 mV och 400° C. corresponding to 15,5 mV. As evident the λ-curves obtained for 387° C. and 400° C. respectively closely follow the specified λ-curve 44 from such high amount of fuel as 1,3 grams per second as far as down to about 0,5 grams per second. Below the said last mentioned value the curve differ from the specified λ-curve and there should be no operation at fluid flows less than about 0,5 grams per second. If the apparatus is to be used for lower fluid flows than about 0,5 grams per second such lower values ought to be related to a λ-curve for higher temperatures which follows the specified λ-curve 44 in a better way, and in such case the electronic unit 34 may be programmed for a first λ-curve for fluid flows down to 0,5 grams per second and a second λ-curve for fluid flows below the said value.

It is to be understood the above specification and the embodiment of the invention illustrated in the drawings is only illuminating examples and that all kinds of different modifications may be presented within the scope of the appended claims.

I claim:

1. Method of dosing the air-fuel mixture in burners of the type which is formed with an evaporator tube through which fuel and some amount of combustion air is introduced in the combustion chamber and is mixed in said chamber with further combustion air and is inflamed, characterized in that the optimum amount of combustion air is determined for different types of fuel and different reference temperatures in a predetermined point of the evaporator tube adjacent the mouth thereof in the combustion chamber, and the temperature of the air-fuel mixture is measured in the said point of the evaporator tube and the actual temperature is compared with a predetermined reference temperature at a given amount of injected fluid, and for an actual temperature below and above respectively the reference temperature the amount of combustion air is reduced and increased respectively in proportion to the measured temperature difference until the actual temperature has increased and dropped respectively to the reference temperature, whereby the burner in the combustion chamber gets the predetermined optimum amount of combustion air.

2. Method according to claim 1, characterized in that the amount of injected fuel is kept constant and in that the dosing of the air-fuel mixture is made solely by controlling the amount of combustion air introduced in the chamber.

3. Method according to claim 1, characterized in that a constant temperature is maintained in the evaporator tube for varying load of the burner, whereby the measured actual temperature in the evaporator tube is compared with the reference temperature for the amount of the injected fuel and the amount of combustion air is controlled to an optimum value whereupon, in case of an increasing load of the burner, the amount of combustion air is increased and in relation thereto the amount of injected fuel is increased so that the predetermined optimum air-fuel mixture is maintained, whereas in case of a decreasing load of the burner the amount of combustion air is reduced and in relation thereto the amount of injected fuel is reduced for maintaining the optimum dosing of the air-fuel mixture.

4. Method according to claim 1 in which the case the burner is connected to a heater, characterized in that a constant temperature is maintained in the working medium of the heater, in that the temperature of the said working medium is observed so that in case of increasing load and thereby a drop of temperature in the said working medium the power of the burner is increased, in that the amount of combustion air is increased and in relation thereto the amount of injected fuel is increased according to the predetermined optimum dosing of the air-fuel mixture until the temperature of the working medium of the heater reaches its predetermined constant level whereas in case of decreasing load and thereby increasing temperature of the working medium the amoumt of combustion air and in relation thereto the amount of injected fuel is reduced.

5. Method according to claims 1, 2, 3 or 4 characterized in that for each particular burner a specified curve for optimum air excess ($\lambda$) is established in relation to injected amount of fuel and is programmed in an electronic unit, a suitable working temperature for the given point of measurement in the evaporator tube is established, whereby the temperature curve as closely as possible corresponds to the specified curve for excess of air whereby the temperature of the evaporator tube is maintained at the said predetermined temperature independently of the load of the burner.

6. Apparatus for dosing the air-fuel mixture in burners having a combustion chamber, in which an evaporator tubes opens and in which a little amount of combustion air is supplied to the evaporator tube and is mixed with the fuel whereas the remaining portion of combustion air is supplied through the bottom of the combustion chamber and in which both the amount of injected fuel and the amount of combustion air can be controlled, characterized in that a thermo element is mounted inside the evaporator tube at a place thereof located inside the combustion chamber, and the said thermo element is connected to an electronic unit to which also the control means for fuel and combustion air are connected and which can be programmed for an optimum relationship combustion air to fuel and which gives an exact dosing of combustion air-fuel mixture according to a predetermined programmed curve.

7. Apparatus according to claim 6, characterized in that the burner is connected to a heater comprising a second thermo element which is likewise connected to the electronic unit and which primarily determines changes of amounts of combustion air, whereas the first thermo element determines the change of amount of injected fuel according to the programmed optimum combustion air-fuel-curve.

* * * * *